United States Patent [19]

Mohlin

[11] 4,436,017

[45] Mar. 13, 1984

[54] MUZZLE BRAKE FOR ARTILLERY GUNS

[75] Inventor: Kjell Mohlin, Karlskoga, Sweden

[73] Assignee: Aktiebolaget Bofors, Bofors, Sweden

[21] Appl. No.: 351,055

[22] Filed: Feb. 22, 1982

[51] Int. Cl.[3] ..... F41F 17/12

[52] U.S. Cl. ..... 89/14 C

[58] Field of Search ..... 89/14 C, 14 R; 42/79; 241/100.5

[56] References Cited

U.S. PATENT DOCUMENTS

| | | | |
|---|---|---|---|
| 827,259 | 7/1906 | McClean | 89/14 C |
| 2,206,568 | 7/1940 | Hughes | 89/14 C |
| 2,362,996 | 11/1944 | Green | 89/14 C |
| 2,398,298 | 4/1946 | Finlay | 89/14 C X |
| 2,743,875 | 5/1956 | Brezosky | 241/100.5 |
| 2,852,983 | 9/1958 | Netzer | 89/14 C |
| 3,045,379 | 7/1962 | Cutts | 42/79 |
| 3,676,947 | 7/1972 | Ashbrook et al. | 42/79 |

FOREIGN PATENT DOCUMENTS

| | | | |
|---|---|---|---|
| 70612 | 1/1983 | European Pat. Off. | 42/79 |
| 53856 | 4/1890 | Fed. Rep. of Germany | 42/79 |
| 958162 | 9/1949 | France | 89/14 C |
| 972500 | 10/1950 | France | 89/14 C |
| 908944 | 10/1962 | United Kingdom | 89/14 C |

*Primary Examiner*—Donald G. Kelly

*Attorney, Agent, or Firm*—Pollock, Vande Sande & Priddy

[57] ABSTRACT

A muzzle brake for artillery guns having a sidewardly open body attached to the muzzle of the barrel of gun. The body includes in a forward direction a front wall having a central opening for gun projectiles. The diameter of the opening being open to include an exchangeable wear ring attached to the front wall. The exchangeable wear ring is held in place by a plurality of locking devices. The wear ring is easily replaced and less expensive than a complete muzzle brake change.

3 Claims, 8 Drawing Figures

MUZZLE BRAKE FOR ARTILLERY GUNS

The present invention relates to a muzzle brake for artillery guns especially intended for direct firing guns such as combat vehicle or tank guns but also useful on indirect firing guns such as howitzers.

Combat vehicle guns and other low mounted guns quite often raise heavy clouds of dust when firing. The dust clouds are real problems to the gun crew as the clouds uncover their position and shield their target and render a second well aimed shot impossible until the dust has cleared.

We have now found that it is possible to reduce these problems considerably by providing direct firing guns with muzzle brakes which divert the main part of charge gases sidewardly while the projectile leaves the gun barrel and passes through the muzzle brake. Muzzle brakes of this type have been used for several years on howitzers and other indirect firing guns to reduce the recoil forces which otherwise influence the gun.

The reduction of the recoil forces obtained with a certain muzzle brake is partly dependent on the design of the muzzle brake body and partly on the size of the front opening for the projectile in the body. The projectile is more or less closing the front opening when passing through the muzzle brake thereby forcing the charge gases to leave the gun muzzle through the muzzle brake's sidewardly projecting gasopenings. The front openings of artillery piece muzzle brakes are however subjected to heavy wear by the charge gases. It is therefore necessary to replace the muzzle brakes after a certain number of rounds are fired with a particular gun. It is also sometimes necessary to replace the muzzle brakes on every artillery piece of a certain type when a new ammunition is introduced.

SUMMARY OF THE INVENTION

According to the present invention these problems are solved by introducing a new type of muzzle brake in which the front opening is defined by an exchangable wear ring. Such a wear ring is easy to replace and is also much cheaper than a complete muzzle brake.

The muzzle brake according the invention thus comprises a muzzle brake body with a front opening for the projectile and sidewardly projecting sideopenings for the charge gases and an exchangable wear ring secured in a front opening of said body by way of certain locking devices. The muzzle brake body is screwed onto the muzzle of the gun barrel in question. The muzzle brake body may be produced by welding together several more or less curved metal plates and machined parts. It may also be casted in one single piece. The wear ring had to be machined to close tolerances.

DESCRIPTION OF THE PREFERRED EMBODIMENT

Figure 1:
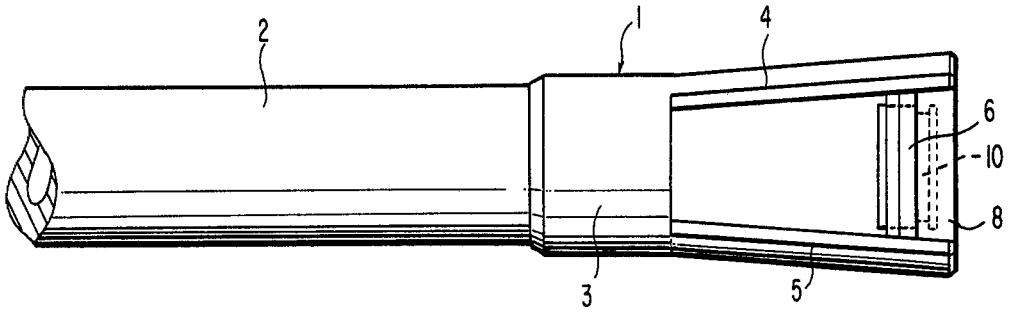
FIG. 1 shows a side view of the front end of a combat vehicle gun to which the muzzle brake according to the invention has been attached.
Figure 2:
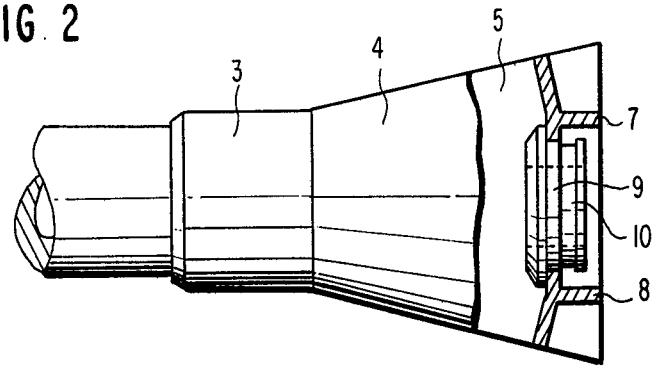
FIG. 2 shows a partly broken away top plan view of said muzzle brake.
Figure 3:
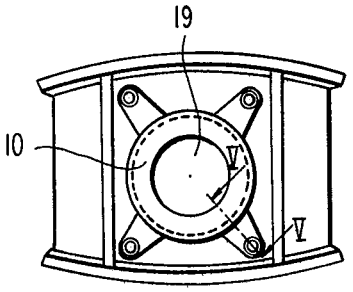
FIG. 3 shows a front end view.
Figure 4:
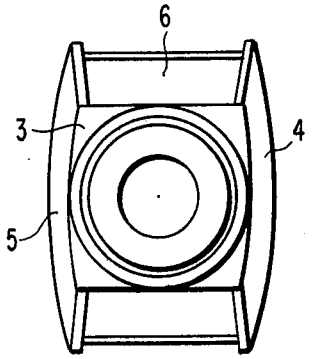
FIG. 4 shows a back end view.

FIG. 1 shows the muzzle of a gun barrel 2 which is fitted with a muzzle brake 1. The muzzle brake 1 is built up by several pieces welded together to a muzzle brake body consisting of a socket 3, an upper and bottom wall 4 and 5 respectively and a front wall 6. The walls 4–6 are somewhat curving as shown on the FIGS. 1–4. The front wall 6 is braced by flanges 7 and 8. The parts 1–8 are welded together along their connecting lines. The body of the muzzle brake including these parts 1–8 may be cast in one piece. It will then be possible to give the body a smoother outer configuration than the embodiment shown on the figures which is mainly built up by curved plates.

Figure 8:
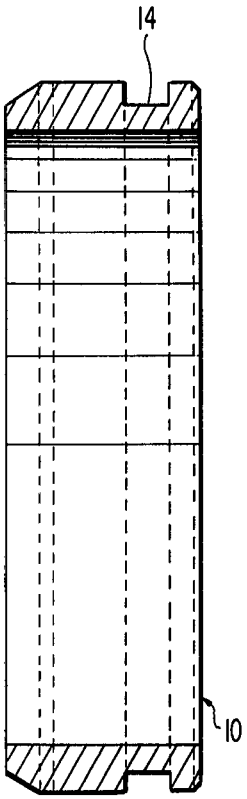
FIG. 6–8 shows enlarged front, top and side views of the wear ring according to the invention.
Figure 6:
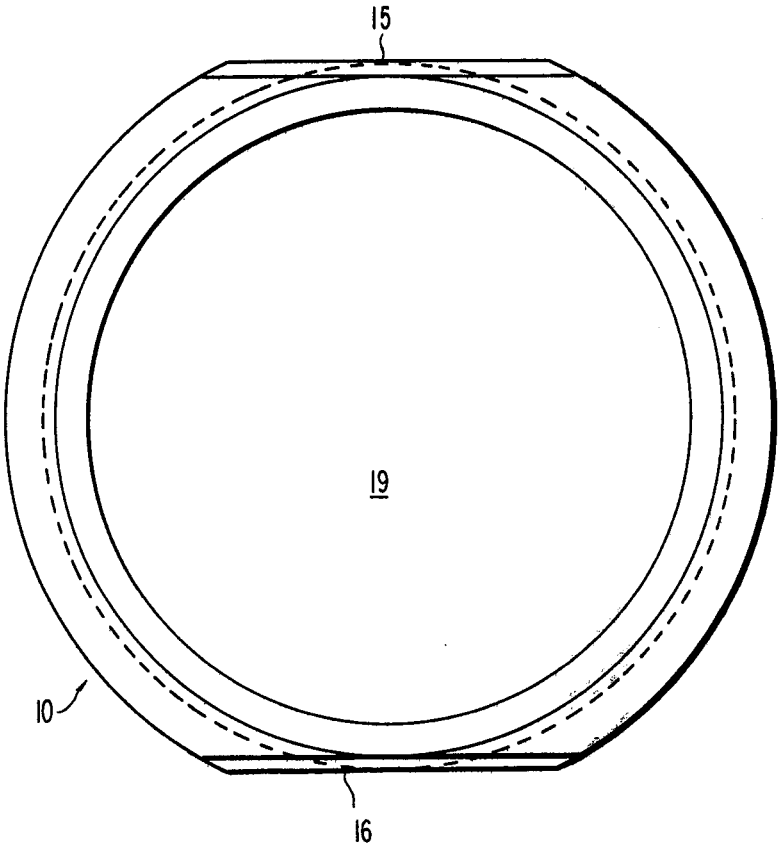
Figure 7:
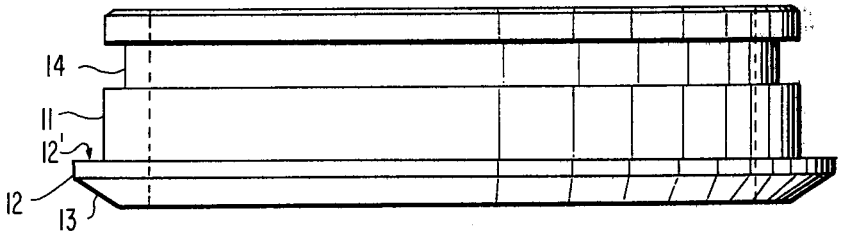

The front wall 6 is provided with a front opening 9. An easily exchangable wear ring 10 is attached in the front opening. The details of the wear ring are shown on FIGS. 6–8. The wear ring has a cylindrical portion 11 provided with an outwardly projecting flange 12 at its rear end. The flange 12 is bevelled at its backwardly faced portion 13 and minor portions of the top and bottom parts 15, 16 of the flange are cut away to make it easier to put the wear ring through one of the side openings of the muzzle brake 1 when installing the wear ring 10 in the front opening 9. The wear ring 10 thus had to be fitted in the front opening 9 from behind with the front wall 12' of the flange 12 fitting up against the backwardly faced surface of the front wall 6. The front part of the cylindrical portion 11 is also provided with a peripherical slot 14.

Figure 5:
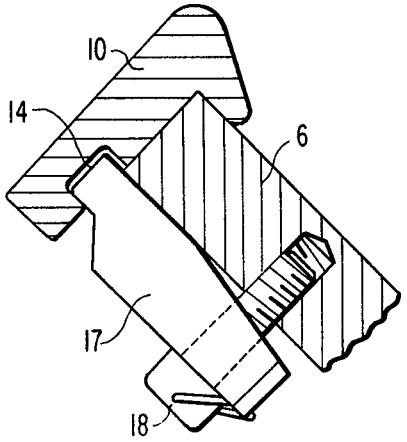
FIG. 5 shows enlarged details along line V—V of FIG. 3

The wear ring is axially slid into opening 9 and fastened to the front wall 6 by way of four locking devices 17 which are fastened to the outer face of the front wall by way of bolts 18. The locking devices 17 engage the slot 14 (see FIG. 5). The wear ring is provided with an axial opening 19 which is carefully calibrated to the projectile and the actual load of the ammunition used by the gun in question.

I claim:

1. A muzzle brake for artillery guns comprising a sidewardly open body attached to the muzzle of the barrel of said gun, said body being defined in the forward direction by a front wall having an outer face provided with a central opening for the gun projectiles, the diameter of said opening being adjusted to the recoil forces initiated by the fire of the gun, the free area of said opening including an exchangeable wear ring axially slid into said opening and attached to the outer face of said front wall of said body.

2. A muzzle brake according to claim 1 wherein the wear ring includes a cylindrical outer surface which is received in the opening in said front wall, and which is restricted at its rear end by an outwardly projecting flange, and which is secured in said opening by locking devices.

3. A muzzle brake according to claim 2 wherein the forward end of said wear ring is provided with a peripheral slot, and said wear ring is secured in the opening in the front wall of the body with several locking devices attached to said front wall and engaging said slot.

* * * * *